US007909234B2

(12) United States Patent
Maistrellis

(10) Patent No.: US 7,909,234 B2
(45) Date of Patent: Mar. 22, 2011

(54) COMPACT STORAGE DEVICE FOR RECEIPTS, COUPONS AND OTHER SMALL PAPER DOCUMENTS

(76) Inventor: Stephanie Catherine Maistrellis, Atlanta, GA (US)

( * ) Notice: Subject to any disclaimer, the term of this patent is extended or adjusted under 35 U.S.C. 154(b) by 634 days.

(21) Appl. No.: 11/899,130

(22) Filed: Sep. 4, 2007

(65) Prior Publication Data

US 2008/0142518 A1 Jun. 19, 2008

Related U.S. Application Data

(60) Provisional application No. 60/842,259, filed on Sep. 2, 2006.

(51) Int. Cl.

| | |
|---|---|
| ***B65D 37/00*** | (2006.01) |
| ***B65D 27/00*** | (2006.01) |
| ***B65D 51/00*** | (2006.01) |
| ***A45C 13/10*** | (2006.01) |
| ***G09F 3/18*** | (2006.01) |

(52) U.S. Cl. ... 229/67.4; 229/67.1; 206/425; 206/459.5; 206/818; 150/112; 40/661.01

(58) Field of Classification Search ..... 150/112, 150/118; 206/459.5, 818, 425; 292/251.5; 229/67.1, 67.3, 67.4; 24/303; 40/661.01; 220/230; 281/31

See application file for complete search history.

(56) References Cited

U.S. PATENT DOCUMENTS

| | | | | |
|---|---|---|---|---|
| 1,444,811 | A * | 2/1923 | Tarbox | 229/67.3 |
| 3,881,597 | A * | 5/1975 | Dahl, Jr. | 206/737 |
| 4,730,727 | A * | 3/1988 | Petroff | 206/311 |
| 4,905,393 | A* | 3/1990 | Laurie | 40/641 |
| 5,311,685 | A* | 5/1994 | Wyant | 40/359 |
| 5,387,037 | A* | 2/1995 | Daitch | 383/7 |
| 5,711,160 | A* | 1/1998 | Namisniak et al. | 62/125 |
| 5,725,039 | A* | 3/1998 | Macinai et al. | 150/104 |

(Continued)

FOREIGN PATENT DOCUMENTS

JP 08198366 8/1996

(Continued)

OTHER PUBLICATIONS

Written Opinion of the International Searching Authority dated Jul. 14, 2009 issued in International Application No. PCT/US2008/013495.

(Continued)

*Primary Examiner* — Sue A Weaver
(74) *Attorney, Agent, or Firm* — Robert Z. Evora

(57) ABSTRACT

A compact storage organizer comprising an outer casing having a front panel, a bottom panel, a rear panel, an extension panel portion and a closure cover, all hinged and serially connected to each other at adjoining edges. The outer casing further includes a pair of side panel sheets that extend between the front panel and the rear panel defining an enclosed opening. A closure mechanism is provided to fasten the closure cover to the front panel. A file assembly is disposed in the compact storage organizer that includes at least one divider with a magnetic tab system disposed in the enclosed opening between the front and rear panels defining at least two envelope containers sequentially disposed adjacent to each other. The magnetic tab system may be preprinted and personalized according to a user's preference.

10 Claims, 15 Drawing Sheets

U.S. PATENT DOCUMENTS

| | | | | |
|---|---|---|---|---|
| 5,752,589 | A * | 5/1998 | Berg | 190/109 |
| 5,788,073 | A * | 8/1998 | Suryk | 206/425 |
| 6,543,379 | B2 | 4/2003 | Schwartz | |
| 6,607,122 | B1 * | 8/2003 | Ong | 229/67.3 |
| 6,729,790 | B1 * | 5/2004 | Moor et al. | 402/75 |
| 6,892,428 | B2 * | 5/2005 | Reiter | 24/303 |
| 2002/0121775 | A1 | 9/2002 | Sperry | |
| 2003/0074817 | A1 | 4/2003 | Saylor | |
| 2004/0099717 | A1 | 5/2004 | Lee | |

FOREIGN PATENT DOCUMENTS

| | | |
|---|---|---|
| JP | 2522770 | 1/1997 |
| JP | 3650829 | 5/2005 |

OTHER PUBLICATIONS

International Search Report dated Jul. 14, 2009 issued in International Application No. PCT/US2008/013495.

* cited by examiner

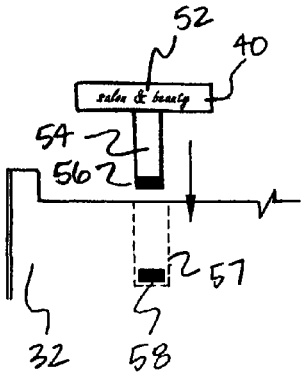
FIG. 5
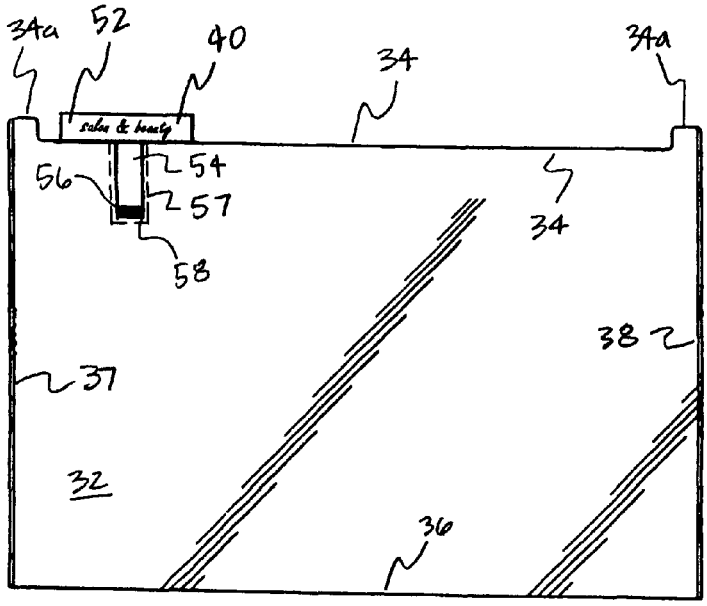
FIG. 6
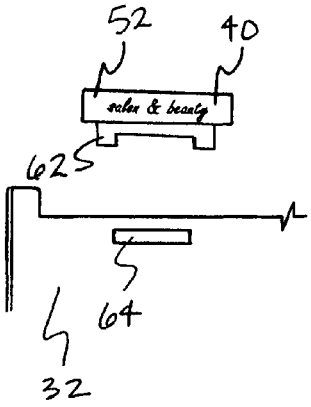
FIG. 7
FIG. 8
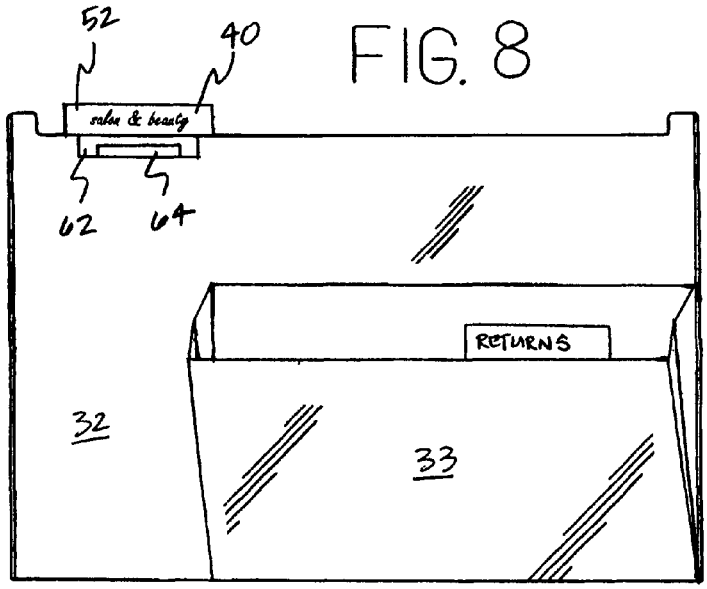

FIG. 10
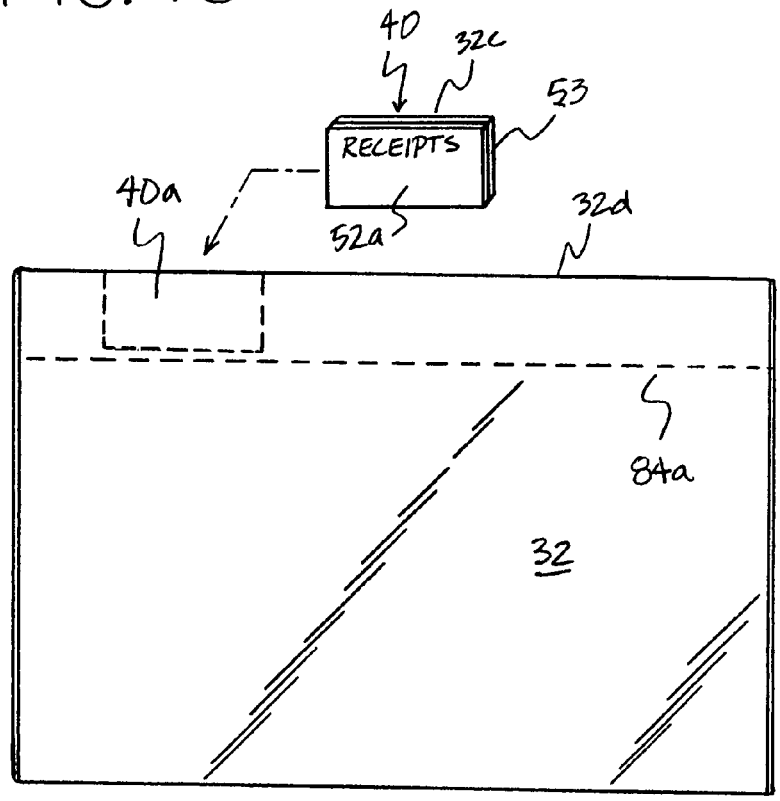
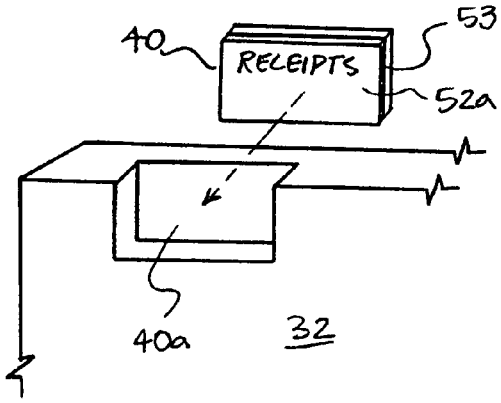
FIG. 11
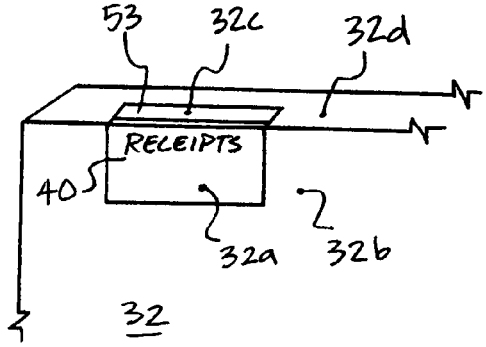
FIG. 12

COMPACT STORAGE DEVICE FOR RECEIPTS, COUPONS AND OTHER SMALL PAPER DOCUMENTS

CROSS REFERENCE TO RELATED APPLICATION

This application is a Non-Provisional which claims the benefit of the filing date of U.S. Provisional Application Ser. No. 60/842,259, entitled "COMPACT STORAGE DEVICE FOR RECEIPTS, COUPONS AND OTHER SMALL PAPER DOCUMENTS" filed Sep. 2, 2006, the entirety of which is incorporated herein.

BACKGROUND OF THE INVENTION

1. Field of the Invention

The present invention relates in general to a compact storage device, and in particular to a flexible, compact accordion style storage device having a unique closure mechanism and tab indexing system for organizing receipts, coupons and other small paper documents in an orderly fashion.

2. Description of the Related Art

Conventionally, a person may carry their receipts and other small paper documents in a pocket of a wallet, a paper envelope, a plastic folder, and/or some other cumbersome manner. These traditional methods are disorganized and difficult to manage.

Likewise, a professional may carry his business receipts in variety of unorganized ways. For example, professionals or business travelers often use larger folders such as conventional sized letter and legal sized folders to carry business and travel related receipts. Carrying larger or bulkier than needed folders for smaller receipts and records is not practical and can become awkward or cumbersome. Making use of the disorganized methods described above thwarts the organization process and causes more confusion and frustration when trying to save receipts and other small documents. As such, it is difficult to specifically identify and compartmentalize the various small paper documents obtained.

Furthermore, previously used organizers have not addressed the need for a portable and compact storage device (such as for example, one measuring approximately 4×6 through 6×9 inches) and is functional in design and size (e.g., length and width) to suitably fit within a small space such as a purse, a briefcase, a computer bag, a notebook, a day planner, a person's pocket, a glove compartment and/or some other small area of space.

SUMMARY OF THE INVENTION

An object of the present invention is to provide a portable and compact storage device to categorize, and organize small paper documents and objects. Examples of receipts or paper documents which may be applicable to the invention include the organization of ATM receipts, deposit slips, receipts and coupons from a variety of locations, such as: a bank, a grocery store, a department store, a boutique, a hair salon/spa, a pharmacy, a restaurant/gas, etc. Likewise, utilizing this invention, the business traveler can readily keep track of his receipts from a hotel, a restaurant, for transportation, airfare, tips and the like.

This invention provides a unique method of organizing and categorizing the various small paper documents within the organizer. In particular, this invention employs a unique tab and divider system to categorize and organize the small paper documents within the organizing folder. According to an exemplary embodiment, magnetic tabs may be pre-printed and personalized according to the user's preference. Thus, the user is able to select categories for organization that best fit his/her needs. Likewise, the magnetic tab function enables the user to easily remove and interchange the tabs and respective printed categories as needed. The dividers within the organizing folder may be constructed from a combination of a metal (such as steel) and a paper material and/or any other material suitable for securing the labels to the tabs. Any suitable metallic composition having magnetic properties may be used in connection with this invention.

According to this invention, the compact storage organizer includes a unique closure mechanism. The closure mechanism includes a circular magnet embedded within a closure flap, and an elongated magnet receptor embedded within a front cover of the compact storage organizer. Irrespective of how full the organizer has been filled, when the closure flap is closed against the front cover, at least a portion of the circular magnet is magnetically attracted to at least a portion of the elongated magnet receptor, thereby securing the closure flap closed against the front cover.

Another object of the invention is to configure the organizer in a portable and compact configuration which will fit comfortably within a small space such as a purse, a briefcase, a computer bag, a notebook, a day planner, a person's pocket, a glove compartment and/or some other small area of space.

Yet another aspect of the invention is to construct the organizer with an external durable and semi-rigid structure. The internal portion of the organizer includes a plurality of semi-rigid dividers which may be individually labeled with indexing label tabs to provide optimal organization.

Another object of this invention is to include features of a wallet and/or a checkbook organizer that include a plurality of retaining sleeves adapted to hold cards, a checkbook, a transaction register and other similar items in a compact manner.

Alternatively, the compact storage device may also include a storage compartments for storing various items, such as indexing label tabs, change, dollar bills and/or any other small loose items in a systematic manner.

A further object of this invention is to construct a sub-divider within a file section divider. The object of this feature is to be able to further sub-divide each of the dividers within a single major divider.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures.

FIGS. 5 and 6 illustrate an internal file section divider including a first embodiment for an indexing label tab according to this invention.

FIGS. 7 and 8 illustrate an internal file section divider including a second embodiment for an indexing label tab according to this invention.

FIG. 10 depicts an internal file section divider including a fourth embodiment for an indexing label tab according to this invention.

FIGS. 11 and 12 show yet another exemplary illustration of an internal file section divider assembled according to another embodiment for the tab system of this invention.

DETAILED DESCRIPTION OF EXEMPLARY EMBODIMENTS

Particular embodiments of the present invention will now be described in greater detail with reference to the figures.

Figure 1:
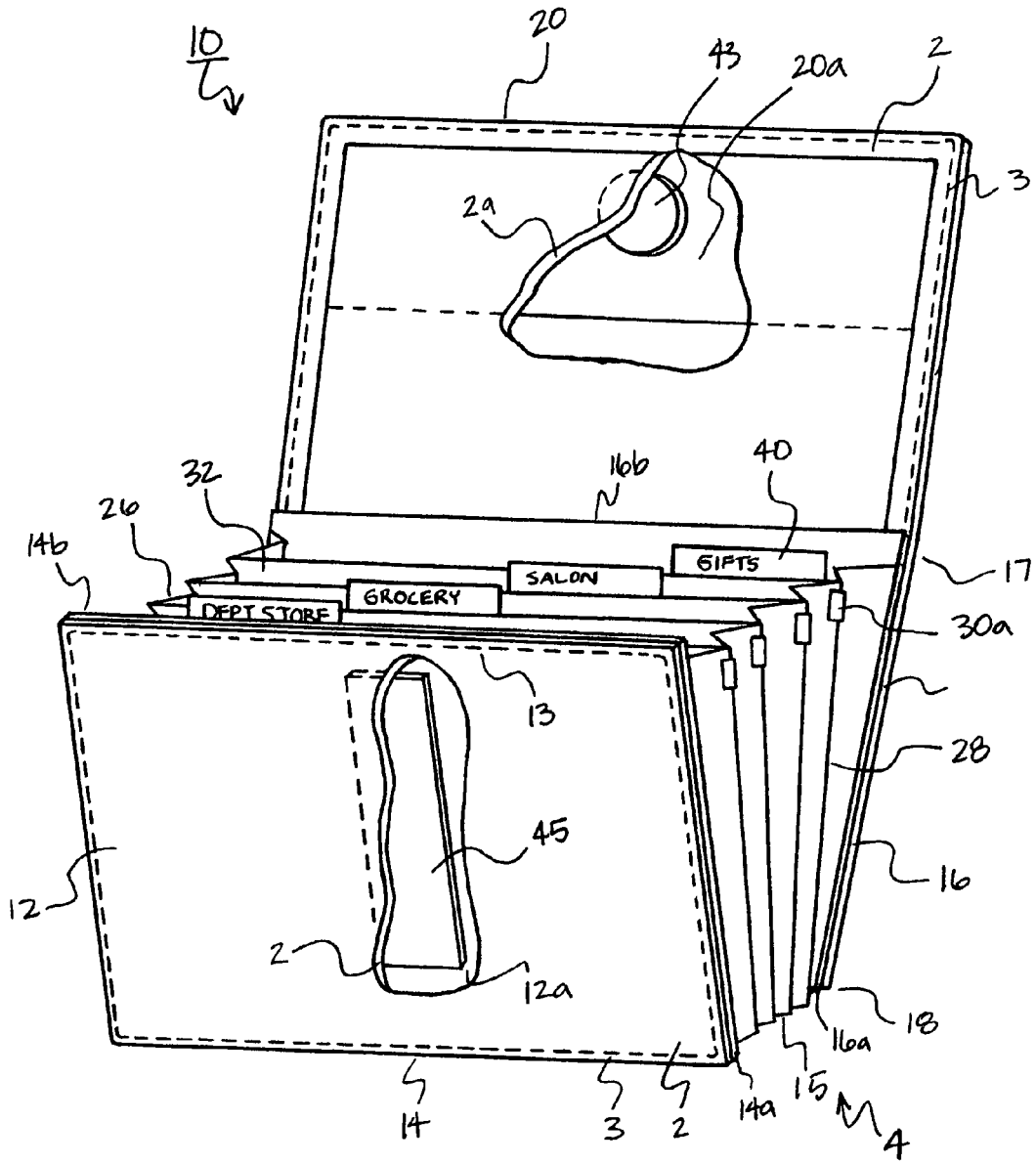
FIG. 1 illustrates a compact storage device including a first closure mechanism according to this invention.

FIG. 1 illustrates a compact storage device 10. As shown, the compact storage device 10 is adapted to address the need for a portable and compact storage device that is functional in design and size to suitably fit within a small space such as a purse, a briefcase, computer bag, a notebook, a day planner, a person's pocket, a glove compartment and/or some other small area of space.

In particular, the compact storage device 10 has a generally rectangular front cover 12 and a generally rectangular back cover 16. The front cover 12 has a top edge 13 and a bottom edge 14. Likewise, the back cover 16 has a top edge 17 and a bottom edge 18. Although shown rectangular in shape, it is to be understood that the compact storage device 10 can take on a variety of different shapes and lengths.

The compact storage device 10 includes a folding closure flap 20 that is foldable over the top edge 13 of the front cover 12. According to this exemplary embodiment, the back cover 16 and the closure flap 20 may be integrally formed as a single semi-rigid material panel. It is to be understood that the back cover 16 and closure flap 20 may be formed integrally or separately and fastened together.

An open container portion 4 of the compact storage device 10 may be constructed as an insert onto which the front cover 12, the rear cover 16 and the cover flap 20 are affixed. FIG. 1, for example, shows an exemplary open container portion 4 constructed from a front cover panel 14*a*, the side gusset panel sheets 26, 28, a bottom cover 15, file section dividers 32, and a rear cover panel 16*a*.

Figure 2:
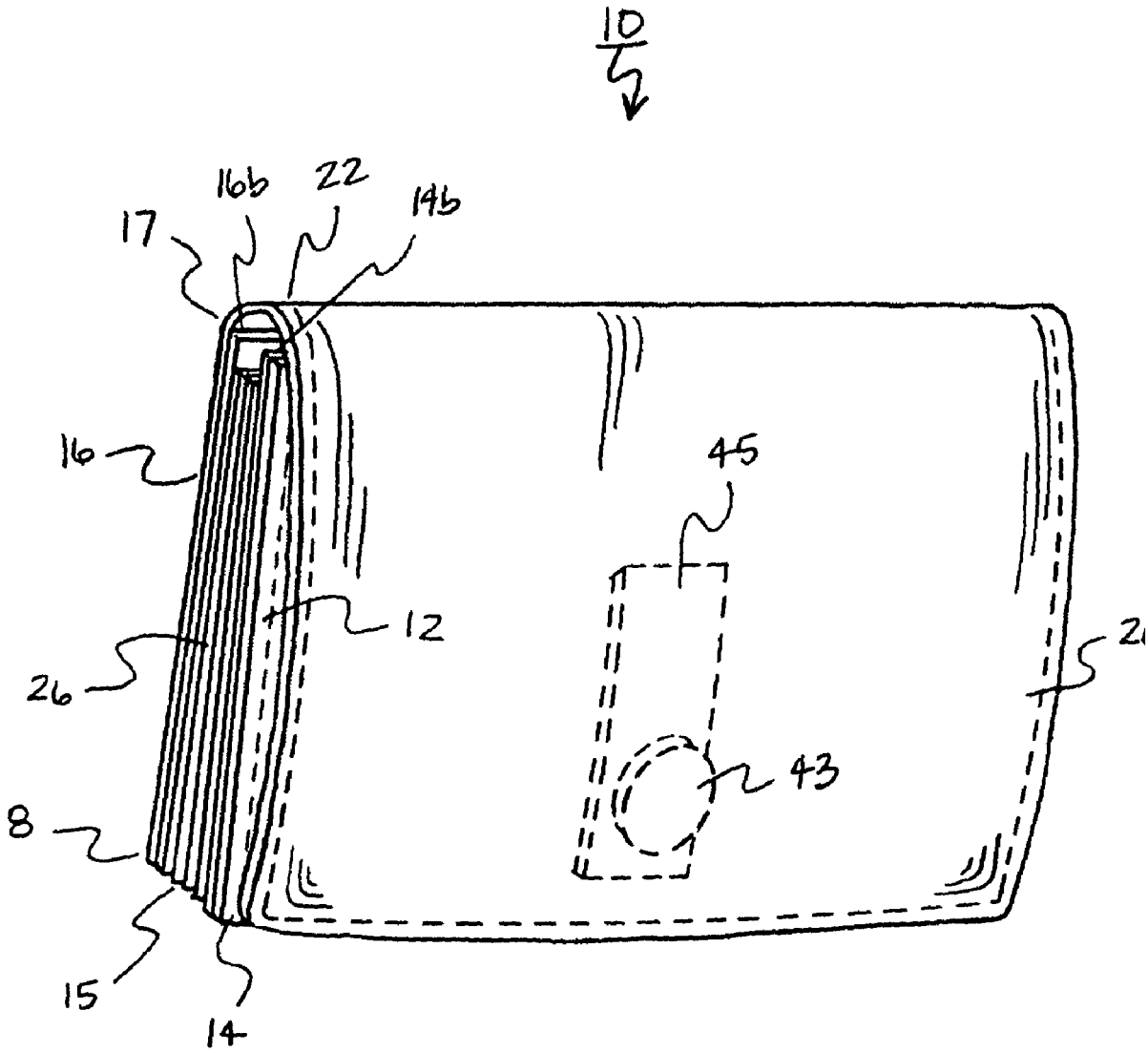
FIG. 2 shows a closed configuration for the compact storage device including the first closure mechanism according to this invention.

The advantage of constructing the open container portion 4 in this manner is that an upper edge 14*b* of the front cover panel 14*a* and an upper edge 16*b* of the rear cover panel 16*a* form a protective ledge. The upper edge 14*b* of the front cover panel 14*a* and an upper edge 16*b* of the rear cover panel 16*a* define a ledge upon which the closure flap 20 may be supported and folded over. The advantage of the protective ledge is that the tab system and none of the index label tabs 40 (described in more detail later) and/or the contents within the compact storage organizer 10 get crushed and thereby destroyed when the cover flap 20 is securely closed against the front cover 12, as shown in FIG. 2.

As shown in FIG. 1, it is also possible to build up the closure flap (and/or any of the panels of the compact storage device 10) by incorporating a reinforced padded material 20*a* into the closure flap 20. It may also be desirable to add reinforced padded material 12*a* to the front cover 12. One advantage of the reinforced padded materials 20*a*, 12*a* is to strengthen the outer protective covering of the compact storage device 10 so that when the front cover 12 and closure flap 20 are brought to a closed stowed position, a durable flat closure may be ensured.

The front cover 12, the bottom cover 15, back cover 16, the central cover 22 and the closure flap 20 may be formed of any number of various materials. These components may be made of a semi-rigid material, such as for example, a fabric, paper, an animal skin (e.g., leather and the like), a metal, a composite, a polymer or plastic material, such as polypropylene or polyethylene and/or any other material now known or later discovered which provides the semi-rigid strength necessary in accordance with this invention.

Another aspect of this invention is to line either one or both of the interior or exterior of the compact storage device 10 and/or layer the various portions of the compact storage device 10 with a material, including but not limited to a fabric, felt, leather, animal skin, a faux material, and an aesthetic design and/or any other type of cover that may provide additional protection against wear and tear and/or to provide an attractive aesthetic appearance.

FIG. 1, for example shows a material liner 2 wrapped around the closure flap 20 and the front cover 12. FIG. 1 also shows another material liner 2*a* disposed beneath the outer material liner 2. Any number of liners may be implemented in accordance with this invention. The various material liners 2, 2*a* may be fastened to the closure flap 20, the front cover 12 and/or any other part of the compact storage device 10 in any number of different ways. FIG. 1 shows the various material liners being fastened to the compact storage device via a fastening threaded stitch 3. The closure flap 20 is secured close against the front cover 12 via a securing mechanism when stowed in a compact portable position. Any number of securing mechanisms may be employed.

In accordance with this exemplary embodiment, FIGS. 1 and 2 depict the closure mechanism as a magnetic closure mechanism. As shown, the magnetic closure mechanism includes a circular magnet 43 embedded within the closure flap 20, and an elongated magnet receptor 45 embedded within the front cover 12. The circular magnet 43 and the elongated magnet receptor 45 are magnetically attracted to each other so that the closure flap 20 may be securely closed against the front cover 12.

It is to be understood that the pair of magnetic elements 43, 45 are interchangeable (between a metal and a magnet), such that element 43 may be constructed as a circular magnet receptor and element 45 may be disposed as an elongated magnet. The magnet receptor may be constructed as a metallic substance (such as for example, a piece of metal or steel, or the like) onto which a magnet may be attracted. Alternatively, the pair of magnetic elements 43, 45 may both be constructed as a pair of magnets so that element 43 is a first circular magnet and element 45 is a second elongated magnet.

The same holds true for the description as it relates to the magnetic tab system and the magnetically attractive closure elements 302 and 304 in FIG. 21, as will be described later.

According to this exemplary embodiment depicted in the cut-away illustration for FIG. 1, a circular magnet 43 and an elongated magnet receptor 45 are provided. The circular magnet 43 may be disposed within the closure flap 20 adjacent to a top edge (as shown in FIG. 1) of the closure flap 20. An elongated magnet receptor 45 (e.g., constructed as an elongated flexible metal sheet) may be embedded within the front cover 12. The elongated magnet receptor 45 extends vertically across the front cover 12 from a lower edge 14 to an upper edge 13 of the front cover 12. The magnet elements 43, 45 used in accordance with this invention may be flexible in design to withstand the repeated closing and folding configuration of the closure flap 20 over the front cover 12. It should also be noted that the magnetic closure mechanism may be constructed as an external magnet snap.

FIG. 2 illustrates that the advantage to this configuration, in that, irrespective of how full the compact storage organizer 10 may be, when the closure flap 20 is closed against the front cover 12, at least a portion of the first circular magnet 43 will be magnetically attracted to at least a portion of the second elongated magnet 45 due to adjustment length afforded by the vertical length of the second elongated magnet 45. As a result, a secure closure between the closure flap 20 and the front cover 12 is ensured.

Although the magnet 43 and the elongated magnet receptor 45 are shown as being circular and an elongated rectangular configuration, it is to be understood that they may take any shape and may be positioned at any location on the compact storage organizer 10 in accordance with this invention in order to secure the closure flap 20 to the front cover 12. Furthermore, the magnet 43 and the elongated magnet receptor 45 may be configured in any number of various thicknesses and lengths sufficient to cause the closure flap 20 to be secured to the front cover 12.

Figure 3:
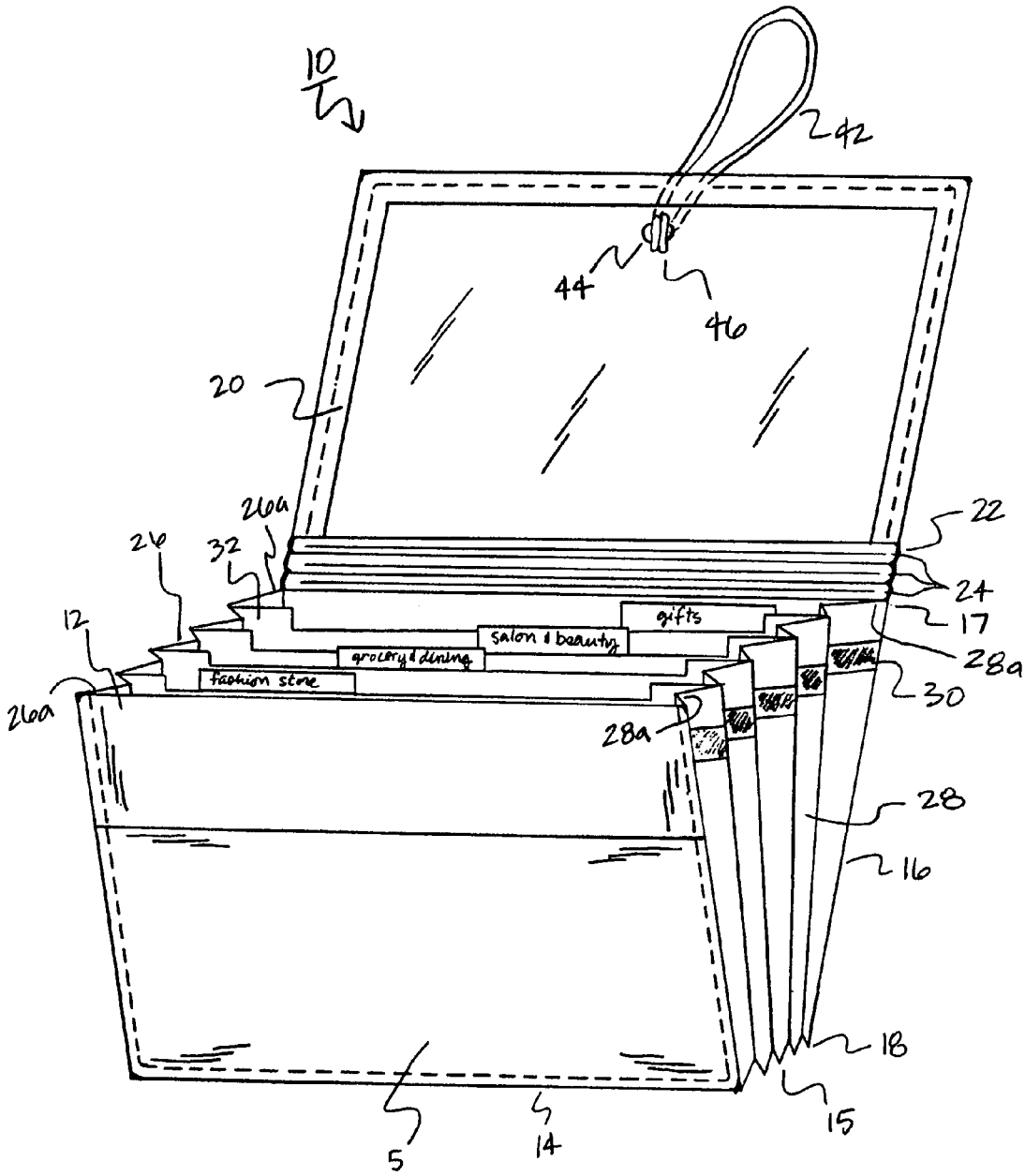
FIG. 3 shows another open configuration for the compact storage device including an alternative securing mechanism according to this invention.

FIG. 3 illustrates an alternative method for fastening the closure flap 20 to the front panel 12. As shown, the closure flap 20 is provided with an elastic strap 42 to secure the compact storage device 10 closed. The elastic strap 42 passes through an opening 44 in the closure flap 20 until an end clip 46 portion of the elastic strap 42 rests against the opening 44 thereby securing the elastic clasp 42 to the closure flap 20. The length of the end clip 46 may be intentionally constructed large enough to prevent the end clip 46 from passing through the opening 44 in the closure flap 20.

In use, the elastic strap 42 may be wrapped vertically (i.e., as shown, from a top edge to a bottom edge) around the compact storage device 10. In the alternative, it is possible for the elastic strap 42 to be stretched from the closure flap 20 downward in a counter clock-wise direction (as shown in FIG. 3) around the compact storage device 10 to a receptor or attachment (not shown), such as a round piece and/or hook onto which the elastic strap 42 may be tied around. The receptor or attachment may be located at a predetermined location on the compact storage device 10. For example, the receptor or attachment may be located on the front cover 12, the rear cover 16 or the closure flap 20. In this stowed position, the elastic strap 42 is under tension and secures the compact storage device 10 closed.

FIG. 3 also shows the back cover 16 and closure flap 20 including a central cover 22 portion. The central cover 22 portion may include articulated expandable seams 24 to allow for the expansion of the compact storage device 10 when numerous papers are stored within the compact storage device 10. A fold at the top edge 17 of the back cover 16 may be disposed to delineate the back cover 16 from the closure flap 20. The front cover 12 of the compact storage device 10 may be formed of a separate, second semi-rigid material as similarly mentioned above with respect to the back cover 16 and the closure flap 20. A bottom cover 15 is disposed between the bottom edge 14 of the front cover 12 and the bottom edge 18 of the back cover 16.

As shown in FIG. 3, a single semi-rigid sheet of material may be configured to integrally make up the front cover 12, the bottom cover 15, the back cover 16, the central cover 22, and the closure flap 20. The single semi-rigid sheet of material may be folded along the bottom edge 14 of the front cover 12 to delineate the front cover 12 from the bottom cover 15 and along the bottom edge 18 of the back cover 16 to delineate the bottom cover 15 from the back cover 16. Finally, the single semi-rigid sheet of material may be folded along the top edge 17 of the back cover 16 to delineate the back cover 16 from the central cover 22 portion of the closure flap 20. Alternatively, it is to be understood that the front cover 12, the bottom cover 15, the back cover 16, the central cover 22 portion and the closure flap 20 may all be separately constructed as separate pieces and then fastened together, such as by being hinged and serially connected to each other at adjoining edges.

FIG. 3 also illustrates the integration of a pocket 5 onto the front cover 12. As shown, the pocket 5 may span across the length of the front cover 12. alternatively, the pocket 5 may be made shorter that the entire width of the front cover 12 and/or any other size or shape in accordance with this invention.

Figure 4:
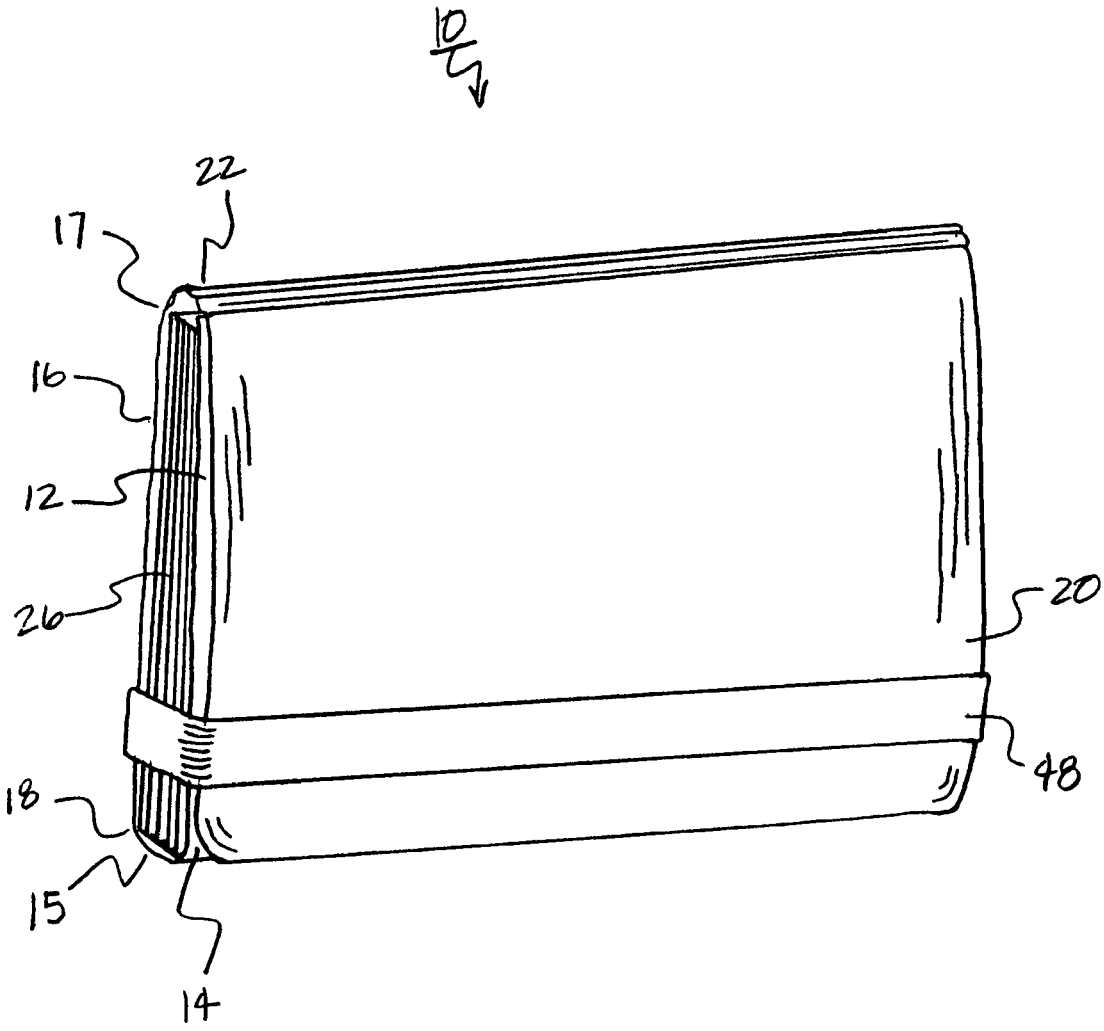
FIG. 4 shows a closed configuration for the compact storage device including another closure mechanism according to this invention.

FIG. 4 illustrates the closure flap 20 secured to the front panel 12 according to yet another exemplary method for fastening the closure flap 20 to the front panel 12. As shown, an elastic band 48 may be provided that may be stretched around: the front cover 12, a pair of side gusset panel sheets 26 and 28 and the back cover 16 into a closed secure position. In operation, the elastic band 48 may be stretched to envelope the entire structure of the compact storage device 10 so that the compact storage device 10 may be transported in a portable and secure manner.

The closure flap 20 may be releasably fastened to the front cover 12 in a variety of different ways as described above. Numerous other alternatives are also possible, such as for example, the closure flap 20 may be fastened to the front cover 12 by a mating hook and eye fastening pads (such as Velcro™ hereafter "Velcro"), a snap and/or any other fastening techniques may be employed that are now known or later discovered in accordance with this invention.

Referring to the side gusset panel sheets 26 and 28 (as shown in FIG. 3) of the compact storage device 10 in more detail. The side gusset panel sheets 26 and 28 originally may have a rectangular shape. As shown, the side gusset panel sheets 26 and 28 are folded back and forth along vertical folds in alternating directions to form a plurality of accordion pleats. Alternatively, the accordion pleats may be formed in an alternating and/or inverted construction. As conventionally known, the front and back ends of each of the side gusset panel sheets 26 and 28 may form thin, narrow, edge margin reinforcement strips 26*a*, 28*a* that may be fastened to the front cover 12 and back cover 16 respectively.

The fastening of the side gusset panel sheets 26 and 28 to the front cover 12 and the back cover 16 may be done in any number of ways, including but not limited to, gluing, heat welding, and/or any other known method for adhering. As shown in FIG. 3, the margin reinforcement strips 26*a*, 28*a* may extend the entire length of the side of the compact storage device 10 side gusset panel sheets 26 and 28 from the top edge 13 to the bottom edge 14 of the front cover 12 and the top edge 17 to the bottom edge 18 of the back cover 16. Similarly, the side gusset panel sheets 26 and 28 and the bottom cover 15 may be permanently secured throughout their entire lengths to the front cover 12 and the back cover 16 by narrow, fabric edge margin reinforcement strips 26*a*, 28*a*. As shown in FIG. 3, the side gusset panel sheets 26 and 28 may be additionally supported by reinforcement bands 30.

Alternatively, and as shown in FIG. 3, clasps 30*a* may be used to fasten the side gusset panel sheets 26, 28 to the file section dividers 32. Furthermore, the clasp 30*a* may be used to fasten any of the various components of the compact storage organizer 10. The clasp 30*a* may be made from a variety of materials including, but not limited to, a polymer, a metal, a fabric and/or any other material capable of fastening that is now known or later developed in accordance with this invention. In the alternative to applying an adhesive, the joints between any of the components of the compact storage organizer 10 may be sewn together to provide an attachment between any of the various components of this invention.

The side gusset panel sheets 26 and 28 may be formed of any material, including for example a durable cloth material, suitable for providing rigidity while being flexed into an accordion shape. Generally, the side gusset panel sheets 26 and 28 may be constructed to be thinner and more flexible than the front cover 12, the back cover 16, bottom cover 15, the central cover 22 and the closure flap 20. For example, materials may be chosen from a semi-rigid material, such as for example, a fabric, a metal, a composite, a polymer or plastic material, such as polypropylene or polyethylene and/or any other material now known or later discovered which provides the semi-rigid strength necessary in accordance with this invention.

As shown in FIG. 3, together, the front cover 12, the back cover 16, the side gusset panel sheets 26 and 28, and the bottom cover 15 define a single expandable pouch pocket. This expandable pouch pocket and the open container portion 4 (as described above in FIG. 1) are constructed to a size and configuration suitable for accommodating small receipts, coupons, and smaller items that are preferably flat in nature.

As shown in FIGS. 1 and 3, within the expandable pouch pocket and the open container portion 4, the compact storage device 10 includes file section dividers 32. The file section dividers 32 may be formed of separate sheets of a semi-rigid material, such as paper and steel sheets, and/or made from any semi-rigid material as mentioned above. For example, file section dividers 32 may be constructed from a combination of paper and steel sheets. The file section dividers 32 may be fastened within the compact storage device 10 in any variety of known methods including gluing the extended sides and/or securing dividers to the sides of the folder using a metal or a plastic clasp 30*a* as shown in FIG. 1.

FIG. 6 shows the exemplary file section dividers 32 depict including a generally rectangular configuration with a horizontal top edge 34 and a horizontal bottom edge 36. The top and bottom edges 34, 36 are mutually parallel to each other. Each of the file section dividers 32 also has mutually parallel side edges 37, 38 which are oriented substantially perpendicular to the upper and lower edges of the side gusset panel sheets 26 and 28. The file section dividers 32 are generally similar in size and shape to the front cover 12 and the back cover 16.

As shown in FIG. 6, the interior portion of the top edge 34 of the file section dividers 32 may be recessed downwardly below the transverse extremities 34*a* of the divider sheet file section dividers 32 to allow for the indexing label tabs 40 to lie substantially flush with the top of the transverse extremities 34*a* of the file section divider 32 within expandable pouch pocket of the compact storage device 10.

Referring again to FIGS. 1 and 3, the file section dividers 32 are coupled to the front cover 12 and the back cover 16 with a plurality of accordion fold pleated connections formed by the side gusset panel sheets 26 and 28. As shown in FIG. 3, margin reinforcement strips 26*a*, 28*a* of the side gusset panel sheets 26 and 28 are secured to the mutually facing surfaces of the front cover 12 and the back cover 16, and are fastened from top to bottom.

An advantage of this invention is that the size of the compact storage device 10 is sufficiently portable to accommodate smaller document papers and items. The size and shape of the compact storage device 10 may be optimized for a variety purposes which may include storing larger paper documents and items, such as letter and/or legal size. It is to be understood that the compact storage device 10 may be designed larger and that the features and objects of this invention may also be applied to a larger storage devices.

According to yet another exemplary embodiment of this invention, indexing label tabs 40 may be fastened to the file section dividers 32 in a plurality of different ways. FIGS. 5, 6, 7, 8, 9, 10, 11 and 12 illustrate various exemplary embodiments for a magnetic index label tab system employing the file section dividers 32 and index label tabs 40 in accordance with this invention.

FIGS. 5 and 6 show one exemplary embodiment for constructing an indexing label tab 40. The indexing label tab 40 includes indicia (or a label) defining a label portion 52 attached to a stem portion 54 having a magnet 56 disposed at one end. An associated file section divider 32 includes a receiving slot 57 having a mating magnet receptor 58 (such as a metallic portion or a second magnet). The stem portion 54 is inserted into the receiving slot 57 disposed on the files section divider 32 until the magnet 56 is magnetically secured to the magnet receptor 58.

As mentioned above with respect to the magnetic elements 43 and 45 in FIGS. 1 and 3, it is to be understood that the magnetic pairing of magnetic elements 56 and 58 may be achieved in a plurality of different ways, for example with a metal and magnet pairing, such as where the stem 54 and element 56 may be made from a metal (so that 56 is magnet receptor 56), and the magnet 58 is provided at a predetermined location to receive the metal stem 54 and magnetic mating receptor 56. Alternatively, the receiving slot may 57 and/or the element 58 (magnet receptor 58) may be constructed as a metal and the magnet 56 is magnetically attracted to the metal slot 57 and/or magnet receptor 58. Furthermore, it is also to be understood that the magnetic elements 56 and 58 may both be magnets and operate to magnetically secure the tab 40 to the file section divider 32.

The advantage of this exemplary embodiment is that the indexing label tabs 40 are aligned and interchangeable and can be quickly replaced as the user desires. It is to be understood that the receiving slot is not necessary and the magnetic tab system can be used simply by associating a magnet with a magnet receptor disposed in or on an associated file section divider 32. Furthermore, the magnet receptor 58 portion may be implemented as a single long magnet receptor (e.g., a metallic portion or a magnet) spanning across the horizontal length of the file section divider 32 so that the indexing label tab 40 may be infinitely located at any position along the horizontal upper edge 34 of the file section divider 32.

FIGS. 7 and 8 show another exemplary embodiment for the indexing label tabs 40. According to this embodiment, an indexing label tab 40 may be constructed of a male connector portion 62 that is attached to a female connector 64. Alternatively, the male connector portion 62 may be fastened directly to the file section divider 32 without the use of a female connector 64. The male connector portion 62 may be made to fasten to the female connector 64 or the file section divider 32 in a variety of different ways including, but not limited to, configuring the male connector portion 62 as a magnetic fastener, a snap-on fastener, a removable adhesive, Velcro attachment and/or any other fastener now known or later described.

The various indexing label tabs 40 may be attached as uniquely described in this application (as shown in FIGS. 5-12) and/or in any conventional manner, such as with an adhesive, by being heat welded and/or any other method for fastening an indexing label tabs 40 at various locations along the top portion 34 of a file section divider 32.

The indexing label tab systems shown in FIGS. 5-12 have broad use capabilities for a variety of organizational uses, including but not limited to, a daily/monthly/yearly planner, a diary, a storage device, a file folder, a storage folder, an expandable file folder pocket, for notebooks, hanging folders, binders and the like. The indexing label tabs 40 may be custom made, color coded, pre-printed, user defined and printed and/or constructing by any method now known or later discovered in accordance with this invention.

FIG. 8 also depicts another aspect of this invention. That is, an additional sub-divider 33 may be incorporated within any one of, or all of, the file section dividers 32. As such, the user can further, and more conveniently, sub-divide at least one of the file section dividers 32 into multiple division compartments. For example, a person can organize the contents of a file section divider 32 by purchase from a "salon and beauty" supply store that the individual chooses to keep and record and those purchases that are to returned in a separate sub-divider 33 entitled "RETURNS."

The sub-divider 33 may be integrated within at least one of the file section dividers 32 in a plurality of different ways. For example, the sub-divider 33 may be attached to either side of at least one of the file section dividers 32 as shown in FIG. 8. Alternatively, the sub-divider 33 may be disposed central within one of the file section dividers 32 and not necessarily attached to one of the sides of the file section dividers 32.

The sub-divider 33 may be attached and/or integrated into at least one of the file section dividers 32 in a variety of different ways, including but not limited to, being glued, adhered, heat-welded, sewn, utilizing an adhesive, a snap attachment, a magnet, Velcro and/or any other method now known or later discovered in accordance with this invention. Alternatively, the sub-divider 33 may be comprised of the same material and constructed similar to the file section dividers 32 described above.

Figure 9:
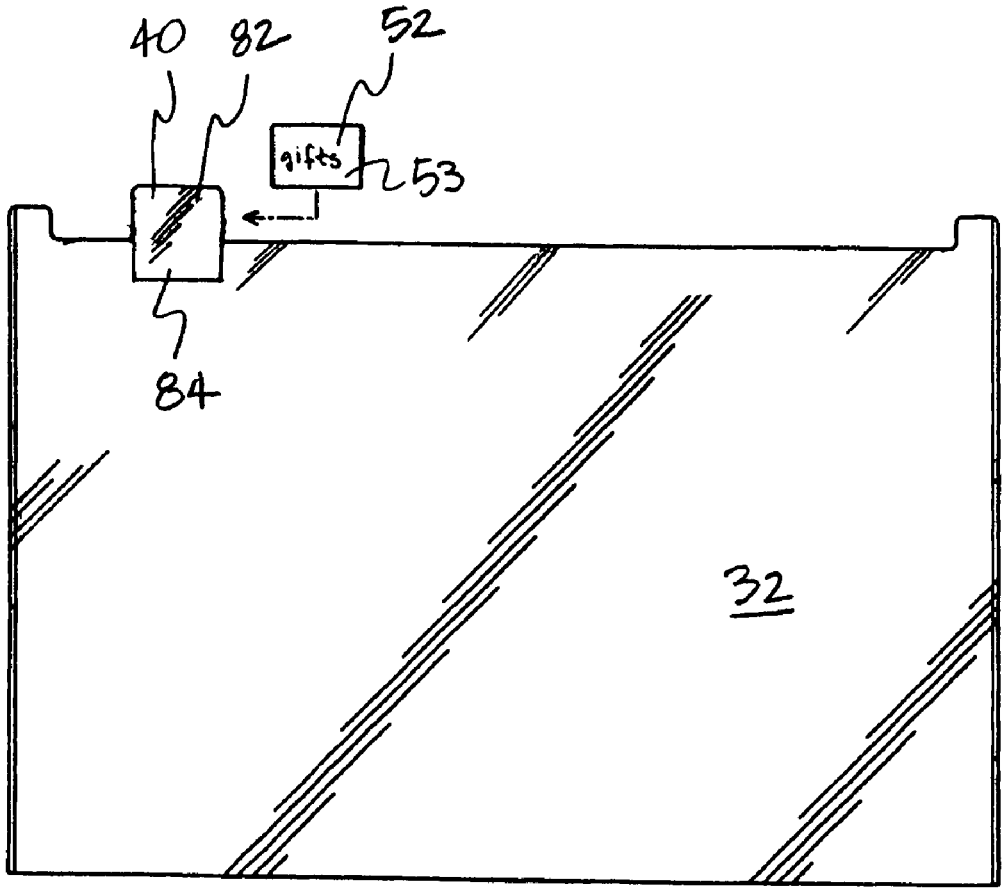
FIG. 9 shows an internal file section divider including a third embodiment for an indexing label tab according to this invention.

FIG. 9 illustrates yet another exemplary embodiment for the indexing label tabs 40. According to this embodiment, the indexing label tab 40 is composed of a tab support portion 82 that protrudes upward from the file section divider 32. The label portion 52 is magnetically secured to the tab support portion 82. The tab support portion 82 may be made of a magnet 84 and the label portion 52 may be constructed as a magnet receptor 53. Alternatively, the label portion 52 may be constructed as a magnet 53 and the tab support portion 82 may be constructed as a magnet receptor 84. The magnet receptor may be composed of a metallic material, such as a thin sheet of steel or the like. On the other hand, both the tab support portion 82 and the label portion may be constructed as a pair of mating magnets.

According to this exemplary embodiment, in operation, the magnet 53 is magnetically secured to the magnet receptor 84 of the tab support portion 82. Although shown at one side of the file section divider, the tab support portion 82 may be disposed anywhere adjacent to the upper edge of the file section divider 32.

FIG. 10 illustrates an alternative embodiment in which a magnet receptor 84*a* portion (as shown in hidden line) may be extended along substantially the entire length of the upper edge 32*d* of the file section divider 32. As such, the magnet 53 and the label portion 52*a* may be disposed on the magnet receptor 84*a* portion in an infinite number of positions along the upper edge 34 of the file section divider 32. Alternatively, instead of the upper portion of the file section divider 32 (as shown in hidden line 84*a*) being constructed as a magnet receptor, it may be constructed as a second elongated magnet 84*a* so that the magnet 53 and label portion 52*a* may be disposed along the second elongated magnet 84*a* anywhere along the upper portion of the file section divider 32.

According to this embodiment, the file section divider 32 is not shown having a top edge recessed below transverse extremities 34*a* (as it is shown in FIG. 9). In FIG. 10, the top 32*d* of the file section divider 32 is continuous and there is no step or recess illustrated. For exemplary purposes, the entire file section divider 32 may be made of a metallic material. As previously mentioned, the index label tab 40 is constructed of a label portion 52*a* and a magnet 53. The magnet 53 is adapted to be magnetically coupled to any location on the metallic file section divider 32. In assembly, the index label tab 40 may be positioned on the file section divider 32 so that the top 32*c* of the index label tab 40 is positioned flush with the top 32*d* of the file section divider 32. However, according to this embodiment, the index label tab 52*a* may be positioned anywhere on the file section divider 32.

FIGS. 11 and 12 illustrate an enlarged view for another variant in which the file section divider 32 includes a recess 40*a* into which the index label tab 40 is to be placed and aligned. As shown in FIGS. 11 and 12, the index label tab 40 is assembled in place within the recess 40*a* so that the front surface 32*a* of the index label tab 40 and the front surface 32*b* of the file section divider 32 are substantially flush with each other. Likewise, in assembly, the top surface 32*c* of the index label tab 40 and the top surface 32*d* of the file section divider 32 are also substantially flush with each other.

The advantage of the flush assembled construction is that the index label tab 40 is captivated flush within the file section divider 32 and is not easily dislocated from the recess 40*a* within the file section dividers 32 because the edges of the index label tab 40, which would otherwise hang up on items, are recessed and not protruding and will not be easily snagged and thereby dislocated from the file section divider 32.

Figure 13:
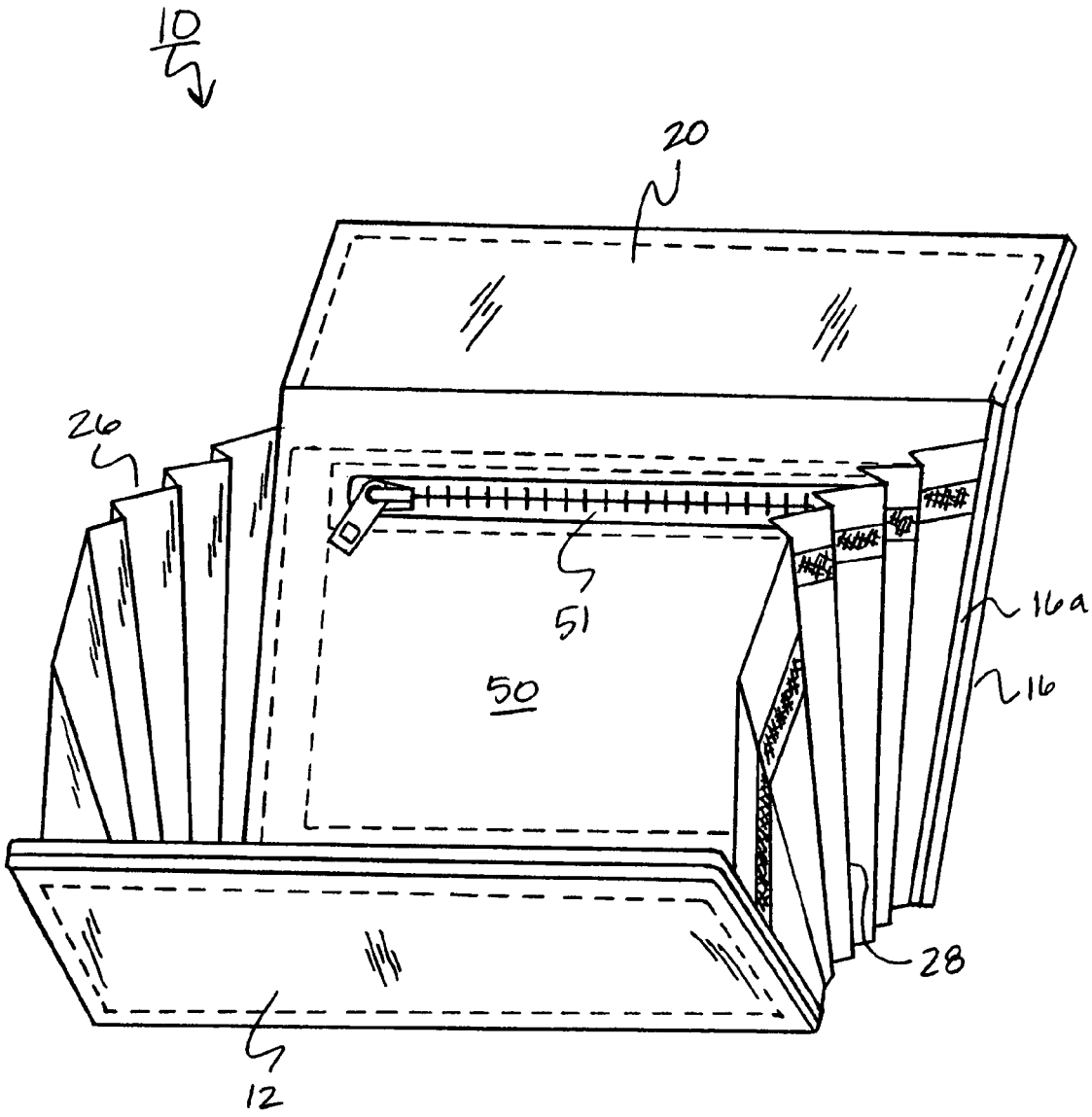
FIG. 13 illustrates the compact storage device including a storage within the compact storage device according to this invention.

FIG. 13 demonstrates the compact storage device 10 including a storage compartment 50 for storing contents on the back inside panel of the back cover panel 16*a*. The storage compartment 50 includes a zipper 51 closure that secures the contents of the storage compartment 50. The storage compartment 50 can be embodied by any type of sleeve, pocket or similar thin envelope adapted for receiving various items.

The advantage of placing the storage compartment 50 within the compact storage device 10 is to allow for bulk and expansion within the compact storage device 10 while preventing distortion and/or bulkiness to the external material covering of the compact storage device 10. Also, placing the storage compartment 50 on the inside of the compact storage device 10 is beneficial when, for example, the storage compartment 50 accidentally opens and/or breaks; the contents within the storage compartment 50 will fall into the compact storage device 10 and will not be lost as they would be securely captivated within the closed compact storage device 10. However, there are other advantages to placing the storage compartment 50 on the outer panels of the compact storage device 10.

Figure 14:
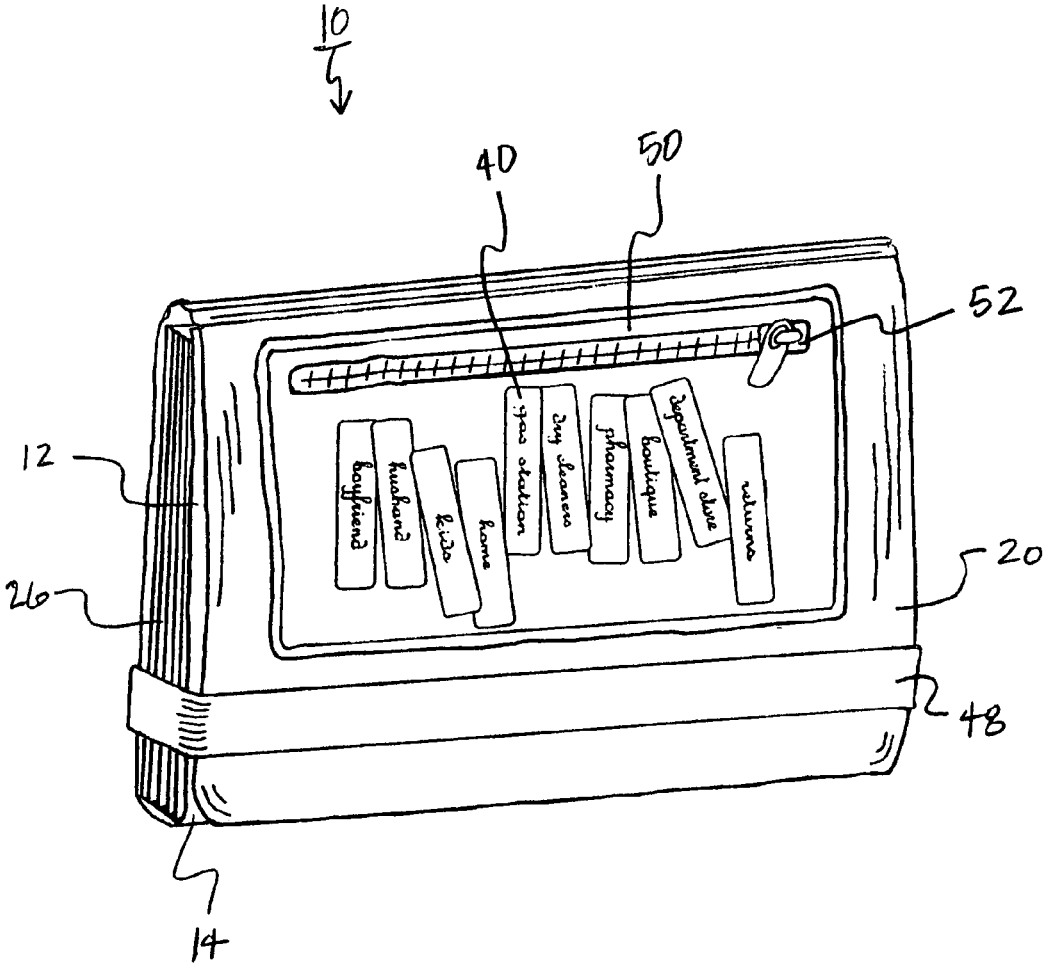
FIG. 14 is an illustration of a compact storage device including a storage compartment disposed on the outside of closure flap according to this invention.

FIG. 14 illustrates that the storage compartment 50 may be disposed anywhere on the compact storage device 10, such as for example, on the outside of the closure flap 20. The storage compartment 50 may be disposed within any of the file section dividers 32 and/or any of the file section dividers 32 may be replaced by a storage compartment 50.

The storage compartment 50 may be affixed to the compact storage device 10 in a variety of different ways, including but not limited to, providing an adhesive, heat welding the edges of the storage compartment 50 and/or any other mode for fastening now known or later discovered in accordance with this invention. Furthermore, any type of closure mechanism may be used, including but not limited to, a zipper, a snap, a magnetic, a zip-lock-type of seal, Velcro, a releasable adhesive, and the like.

Figure 15:
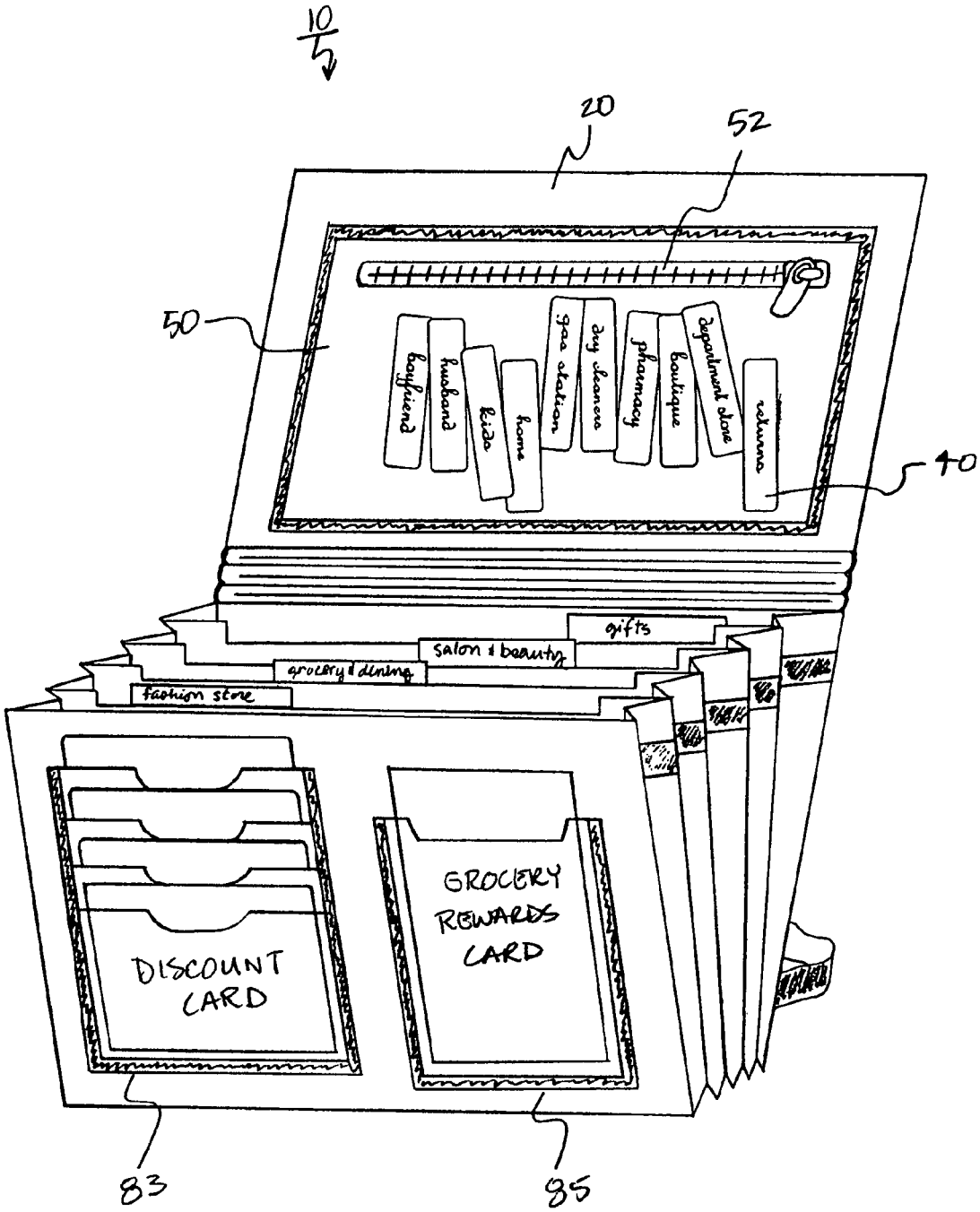
FIG. 15 illustrates the compact storage device including a storage compartment and a pair of card retaining sleeves according to this invention.

FIG. 15 shows the implementation of a plurality of various types of retaining sleeves 83, 85, 87, 89 and/or pockets on the compact storage device 10. In FIG. 15, a first card retaining sleeve 83 may be disposed to receive numerous cards to secure the cards in a tiered fashion to maximize a minimum amount of space to hold numerous cards. Alternatively, a second card retaining sleeve 85 is shown in which a single card is secured to the front cover 12 of the compact storage device 10.

It is further understood that the card retaining sleeves 83, 85 may be disposed anywhere on the compact storage device 10. For example, the card retaining sleeves 83, 85 may be disposed within any one of the file section dividers 32 into which various cards can be stored. Instead of the user carrying around numerous cards in their wallet, the card retaining sleeves 83, 85 in the compact storage device 10 may be used to hold various cards which are not used as frequently by the user and which would otherwise bulk up his or her wallet. An example of cards that may be used less frequently by a user may include, for example, a rewards card, a grocery card, discount cards, access cards, a movie pass, a gym card and/or any other card.

The retaining sleeves 83, 85, 87, 89 may also be heat welded, glued and/or attached in any other suitable manner in accordance with the objects and features of this invention. As mentioned later, in the case where a material fabric is disposed over various portions of the compact storage device 10, slots may be provided within the material fabric for receiving the various cards.

Figure 16:
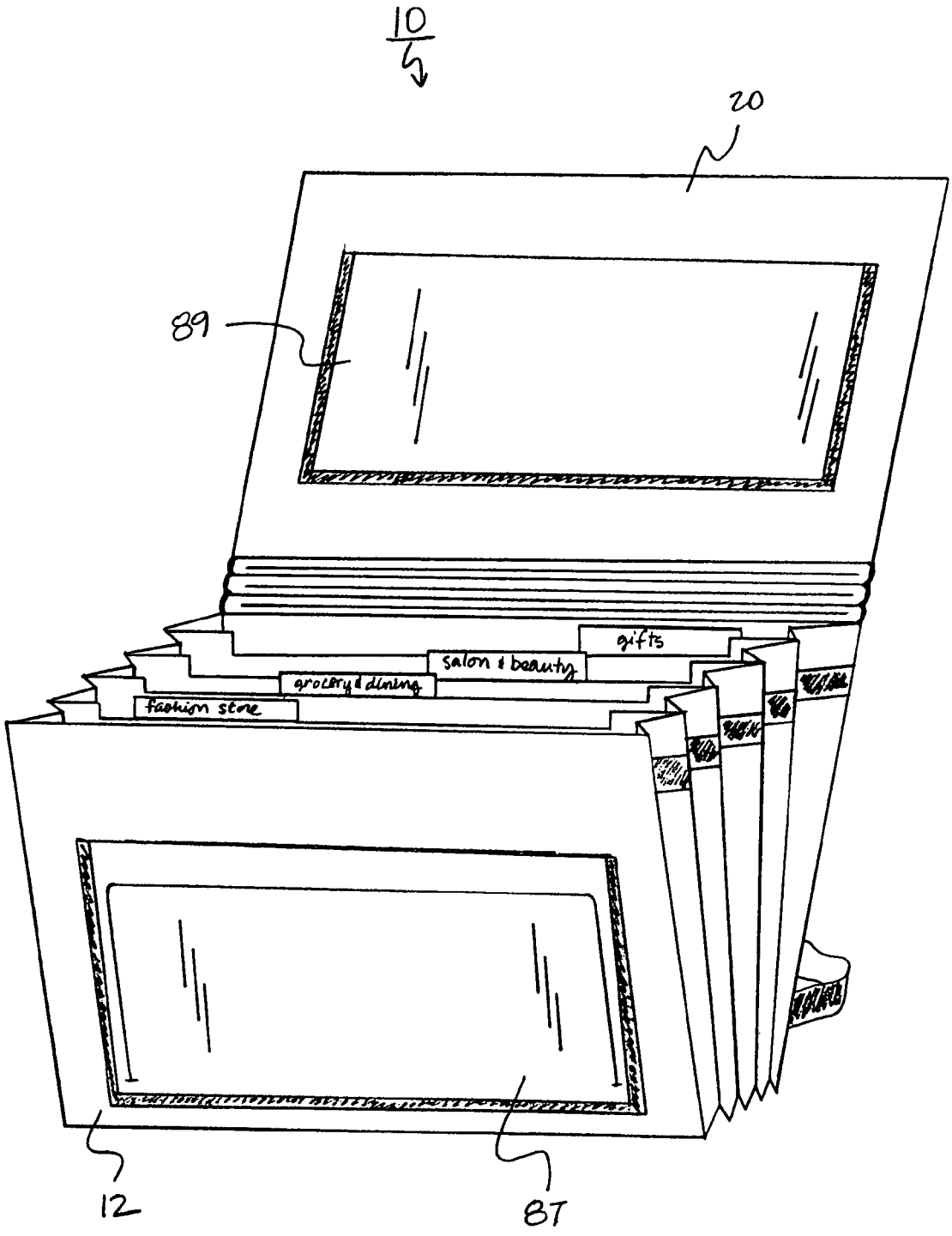
FIG. 16 shows an open configuration for another alternative embodiment illustrating a checkbook organizing system including a retaining sleeve for a checkbook and a retaining sleeve for a transaction register according to this invention.
Figure 17:
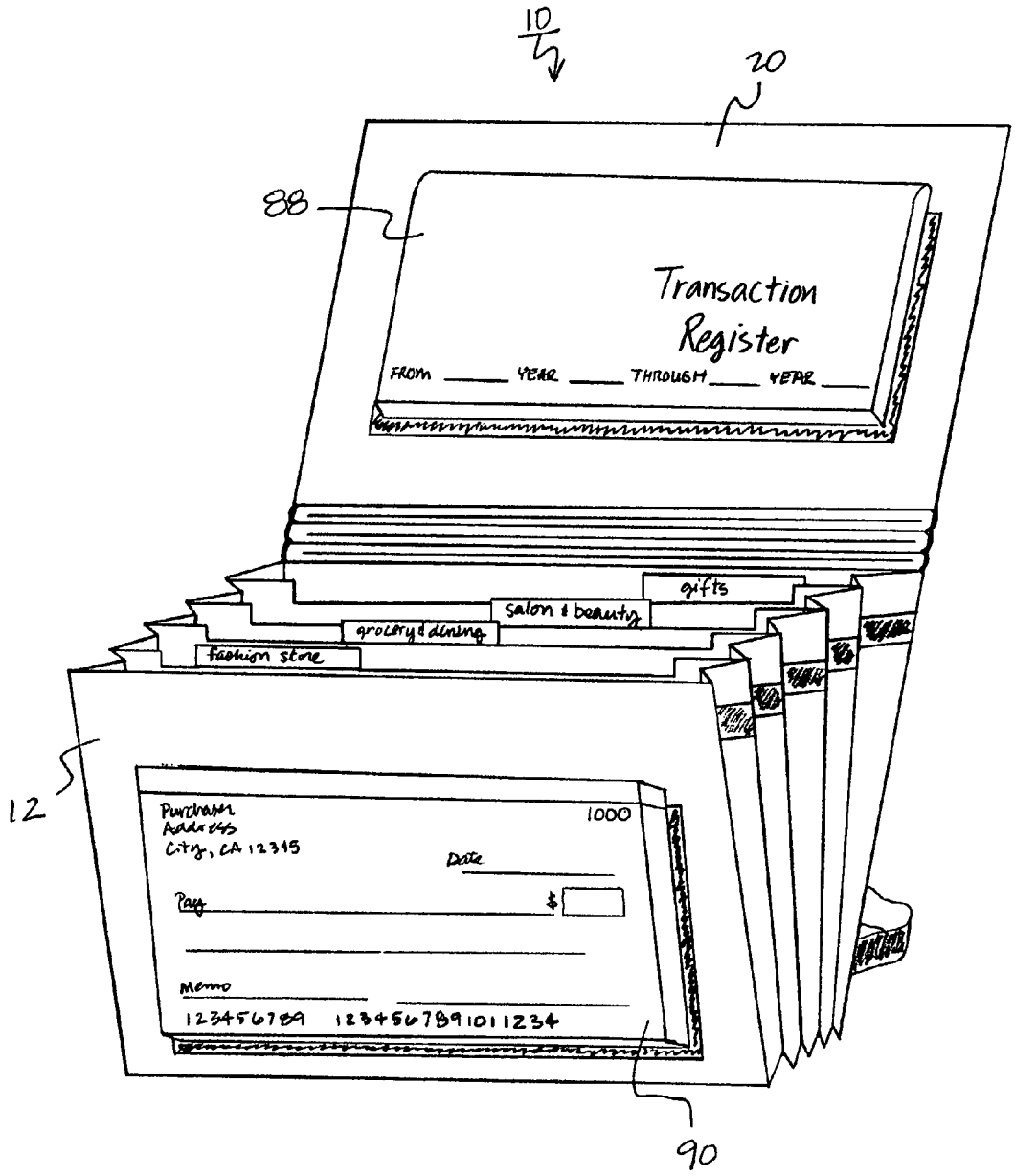
FIG. 17 shows an open configuration for the compact storage device including the checkbook and the transaction register according to this invention.

FIGS. 16 and 17 illustrate another exemplary embodiment of this invention to include features of a wallet and/or a checkbook style organizer. FIG. 16 shows a pair of retaining sleeves 87, 89. A first retaining sleeve 87 may be disposed on the front cover 12 adapted to hold a checkbook 90 as shown in FIG. 17. A second retaining sleeve 89 may be disposed on the closure flap 20 adapted to hold a transaction register 88 (as shown in FIG. 17) in which each of the checks written by the user may be recorded. The advantage of this configuration is that the user has the convenience of portably carrying their checkbook 90 and transaction register 88 in an organized manner along with the users other financial accounting items.

The compact storage device 10 may be configured to include a change or dollar bill compartment (not shown, but similar to the compartment 50). The compact storage organizer 10 may be configured to include a change or dollar bill compartment to carry around loose change or dollar bills in a systematic manner.

The retaining sleeves 83, 85, 87 89 may be constructed of various sizes and shapes and may be used to hold a number of different compact items, including for example, a pad of paper, a pen and/or any other compact item in accordance with this invention.

Figure 18:
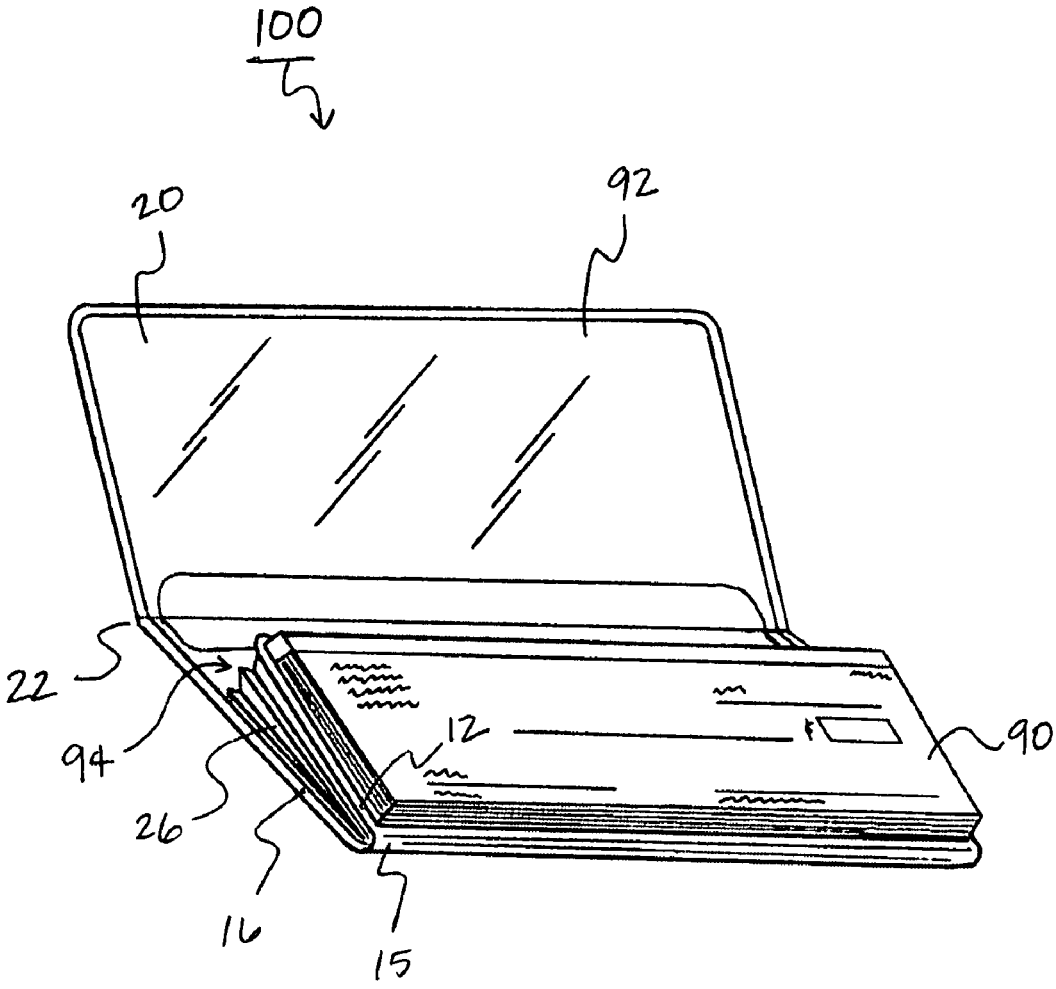
FIG. 18 illustrates a compact checkbook billfold storage device having expandable gussets and a tab system according to this invention.

FIG. 18 illustrates a compact checkbook billfold storage device 100 according to another aspect of this invention. The compact checkbook billfold storage device 100 includes a front cover 12, bottom cover 15, a back cover 16, a central cover 22 portion, a closure flap 20, and side gusset panel sheets 26 and 28 which define a pouch container portion 94.

As shown, a transaction register 88 (as shown in FIG. 18) may be secured to the retaining sleeve 92 disposed on the closure flap 20 and a checkbook 90 may be secured to the front cover 12 of the compact checkbook billfold storage device 100.

The pouch container portion 94 is adapted to receive file section dividers 32 and indexing label tabs 40 in accordance with this invention and as shown and described in the various figures above. The file section dividers 32 may also be subdivided by additional sub-divider 33 portions. Within the file section dividers 32 and sub-divider 33, various small paper documents may be stored. This pouch container portion 94 is configured in size to suitably accommodate small receipts, ATM receipts, deposit slips, coupons, small paper documents and other smaller items that are preferably flat in nature.

Figure 19:
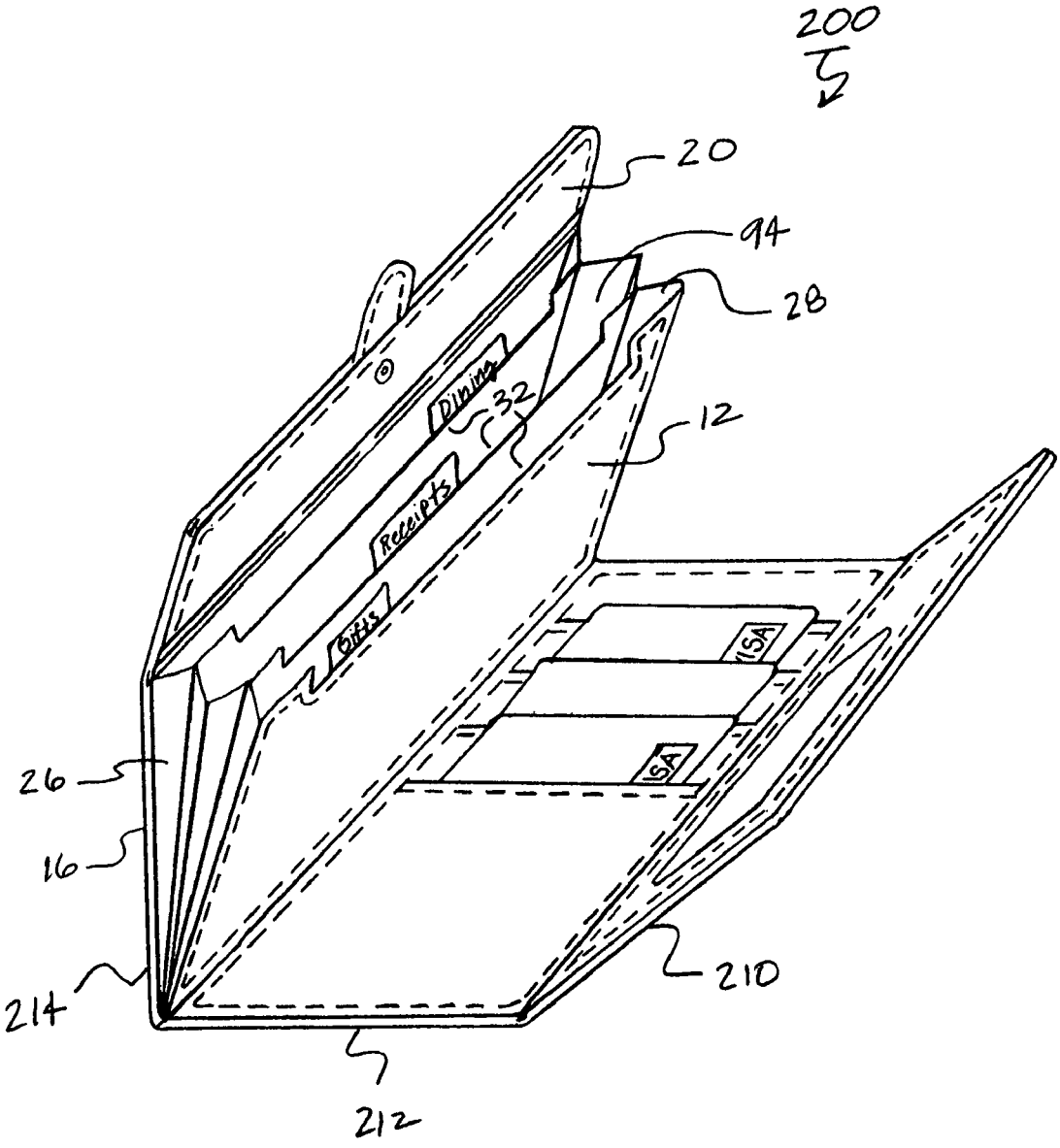
FIG. 19 illustrates a wallet storage device having expandable gussets and a tab system according to yet another aspect of this invention.

FIG. 19 illustrates a wallet storage device 200 according to yet another aspect of this invention. The wallet storage device 200 may include all of the features and functionality of the compact storage devices 10, 100 described above. The exemplary wallet storage device 200 illustrated is shown as a tri-fold wallet including a first panel 210, a second panel 212, a third panel 214 and a closure flap 20. The wallet storage device 200 includes an expandable pouch container portion 94. The pouch container portion 94 is defined by a front cover 12, a back cover 16 and side gusset panel sheets 26 and 28. A plurality of file section dividers 32 and indexing label tabs 40 may be disposed within the pouch container portion 94 for storing and organizing various small paper documents and other items. Additional sub-divider portions may also be implemented to store the various small paper documents in accordance with this invention.

Figure 20:
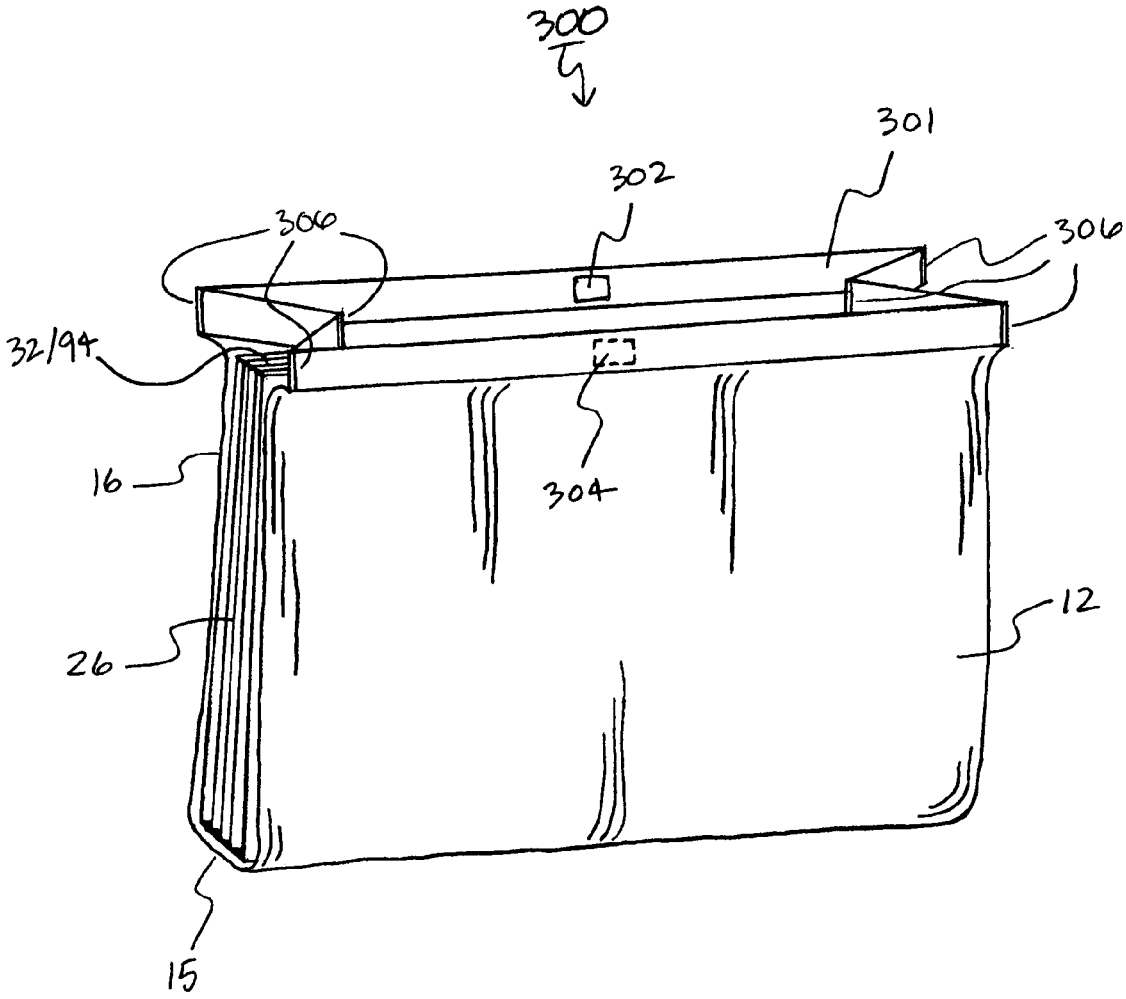
FIG. 20 illustrates a compact storage device including an expandable opening mechanism having expandable gussets and a tab system according to this invention.

FIG. 20 illustrates a compact storage device 300 including an expandable opening mechanism 301. According to this exemplary embodiment, the expandable opening mechanism 301 is constructed of an accordion linkage system. As shown, the accordion linkage system includes a magnet 302 and a magnetic receptor 304 portion which magnetically secure the expandable opening mechanism 301 in a closed position when the magnet 302 and the magnetic receptor 304 portion are magnetically coupled to each other. The compact storage device 300 may include all of the features and functionality of the compact storage devices 10, 100 and 200 described above.

In operation, the expandable opening mechanism 301 expands open about various pivots 306 so that the pouch container portion 94 may be opened to allow the user can gain access to the small paper documents and items within the file section dividers 32. When the compact storage device 300 is to be stowed, the expandable opening mechanism 301 is collapsed so that the magnet 302 and the magnetic receptor 304 portion can be brought close together to form a magnetically secure closure. The pivots 306 may include a biasing element, like a spring, which will also influence the expandable opening mechanism 301 into a secure closed position.

Although shown as a linkage system, the expandable opening mechanism 301 may be selected from a variety of closure mechanisms. Likewise, the magnetic closure element may be selected from a variety of different fastening elements, such as, magnets, a clip, a slot, a string, a snap closure fasteners, Velcro or other types of mutually engageable and releasable fastening devices may be used to secure the compact storage device 300 closed.

Numerous materials may be used as the composition for the compact storage devices 10, the compact checkbook billfold storage device 100, the wallet storage device 200, and the compact storage device 300. For example, a polymer, a rubber, a plastic, a vinyl, cloth, a paper product and/or any other material now known or later discovered may be used to make up the composition of the compact storage devices 10, 100, 200 and 300.

Any type of indicia may be printed onto the compact storage device 10, 100, 200 and 300. The indicia may include, for example, a trademark, a service mark, a name, an expense or receipt category, an emblem, a logo, a banner, an advertisement and/or any other type of indicia. The user can place indicia to support their favorite business, university, school, local establishment, hobbies, and the like. a name, an expense or receipt category, an emblem It will be recognized by those skilled in the art that changes or modifications may be made to the above described embodiment without departing from the broad inventive concepts of the invention, such as for example by employing a loose-leaf compact storage device. It is understood therefore that the invention is not limited to the particular embodiment which is described, but is intended to cover all modifications and changes within the scope and spirit of the invention.

What is claimed is:

1. A compact storage organizer comprising:

an outer casing having a front panel, a bottom panel, a rear panel, an extension panel portion and a closure cover, all hinged and serially connected to each other at adjoining edges, the outer casing further including a pair of side panel sheets extending between the front panel and the rear panel defining an enclosed opening;

a file assembly, comprising at least one metallic divider that magnetically receives a magnetic tab, disposed in the enclosed opening between the front and rear panels defining at least two envelope containers sequentially disposed adjacent to each other; and a closure mechanism fastens the closure cover to the front panel, wherein the metallic divider includes a recess to receive the magnetic tab so that substantially flush external surfaces are formed when the magnetic tab is assembled within the recess of the metallic divider.

2. The compact storage organizer recited in claim 1, wherein the closure mechanism includes a first magnetic portion disposed on the closure cover that magnetically mates with a second magnetic portion disposed on the front panel.

3. The compact storage organizer recited in claim 2, wherein the first magnetic portion is a circular magnet, and the second magnetic portion is an elongated magnet receptor that extends from a lower end to an upper end of the front panel.

4. The compact storage organizer recited in claim 3, wherein the circular magnet is embedded within the closure cover, and the elongated magnet receptor is embedded within the front panel.

5. The compact storage organizer recited in claim 1, wherein the closure mechanism includes a circular magnet embedded within the closure cover, and an elongated magnet receptor embedded within the front panel, so that irrespective of how full the organizer is, when the closure cover is closed and lies against the front panel, at least a portion of the circular magnet is magnetically attracted to at least a second portion of the elongated magnet receptor, thereby securing the closure cover closed against the front panel.

6. The compact storage organizer recited in claim 1, wherein the magnetic tab includes indicia for indexing a category.

7. The compact storage organizer recited in claim 1, including a clasp is used to fasten the metallic dividers to the side panel sheets of the compact organizer by a clasp.

8. The compact storage organizer recited in claim 1, further including a sub-divider having an expandable gusset integrated onto the metallic divider to further divide the enclosed opening into multiple division compartments.

9. The compact storage organizer recited in claim 1, further including a pocket for securing small items, wherein the pocket can be constructed from at least one of: an open pocket sleeve and a pocket including a sealable closure mechanism.

10. A magnetic tab system for dividing an internal compartment of an organizer comprising:

a magnetic tab;

indicia disposed on the magnetic tab depicting a category; and a metallic divider that magnetically receives the magnetic tab, wherein the metallic divider includes a recess to receive the magnetic tab so that substantially flush external surfaces are formed when the magnetic tab is assembled within the recess of the metallic divider.

* * * * *